US010933638B2

(12) United States Patent
Watanabe et al.

(10) Patent No.: US 10,933,638 B2
(45) Date of Patent: Mar. 2, 2021

(54) INKJET HEAD AND INKJET RECORDING DEVICE

(71) Applicant: KONICA MINOLTA, INC., Tokyo (JP)

(72) Inventors: Toshiki Watanabe, Machida (JP); Masahiro Saito, Hino (JP); Zen Kayaba, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/649,404

(22) PCT Filed: Sep. 20, 2017

(86) PCT No.: PCT/JP2017/033873
§ 371 (c)(1),
(2) Date: Mar. 20, 2020

(87) PCT Pub. No.: WO2019/058445
PCT Pub. Date: Mar. 28, 2019

(65) Prior Publication Data

US 2020/0298564 A1 Sep. 24, 2020

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/14072; B41J 2002/14491; B41J 2/1433

(Continued)

(56) References Cited

U.S. PATENT DOCUMENTS 9,604,458 B1 * 3/2017 Sugiura ..... B41J 2/1433
2007/0182787 A1 * 8/2007 Kubo ..... B41J 2/14209 347/58

(Continued)

FOREIGN PATENT DOCUMENTS

JP 2014004767 A 1/2014
JP 2016135560 A 7/2016

OTHER PUBLICATIONS

International Search Report issued in PCT/JP2017/033873; dated Nov. 21, 2017.

(Continued)

*Primary Examiner* — An H Do
(74) *Attorney, Agent, or Firm* — Cantor Colburn LLP

(57) ABSTRACT

An inkjet head includes: an ink ejector in which an opening of a nozzle is provided in an ink ejection surface, and which includes an actuating element that performs an operation for ejecting ink; a wiring board that is provided with a circuit wiring electrically connected to the actuating element, and is disposed in a direction crossing the ink election surface on a side opposite to the ink ejection surface of the ink ejector; an exterior member that covers the ink ejector and the wiring board while exposing the ink ejection surface of the ink ejector and a part of the wiring board; and a wiring cable that is attached to a connection terminal disposed in an area exposed front the exterior member on one surface of the wiring board so as to be electrically connected to the circuit wiring.

9 Claims, 10 Drawing Sheets

(58) Field of Classification Search
USPC ..... 347/50, 58, 59
See application file for complete search history.

(56) References Cited

U.S. PATENT DOCUMENTS

| | | | | |
|---|---|---|---|---|
| 2008/0001999 | A1* | 1/2008 | Ciminelli | B41J 2/1753<br>347/58 |
| 2019/0184703 | A1* | 6/2019 | Yamada | B41J 2/14233 |

OTHER PUBLICATIONS

PCT International Preliminary Report on Patentability with Written Opinion for corresponding to PCT/JP2017/033873; dated Mar. 24, 2020.

* cited by examiner

INKJET HEAD AND INKJET RECORDING DEVICE

CROSS REFERENCE TO RELATED APPLICATIONS

This is the U.S. national stage of application No. PCT/JP2017/0338763, filed on Sep. 20, 2017, the disclosure of which is also incorporated herein by reference.

TECHNOLOGICAL FIELD

The present invention relates to an inkjet head and an inkjet recording device.

BACKGROUND ART

There is a related-art inkjet recording device that forms an image and a microstructure by ejecting fluid such as ink from an opening of a nozzle provided in an ink ejection surface of an inkjet head to a desired position. The inkjet head of the inkjet recording device includes an ink ejector that ejects ink from the opening of the nozzle in response to the operation of an actuating element such as a piezoelectric element that changes the pressure inside an ink reservoir communicating with the nozzle. The inkjet head typically includes, as a structure for the path for a signal for driving the actuating element, a wiring board provided with a circuit wiring electrically connected to the actuating element, and a wiring cable electrically connected to the circuit wiring via a connection terminal disposed on the surface of the wiring board, in addition to the ink ejector described above. The wiring board is usually disposed in the direction crossing the ink ejection surface, on the side opposite to the ink ejection surface of the ink ejector.

In the inkjet recording device, ink scatters when replacing an ink supply tube for supplying ink to the inkjet head. Also, mist of ink (ink mist) is generated when ink is ejected from the opening of the nozzle. If such ink adheres to the above-described connection terminal of the inkjet head, an electrical connection failure occurs between the circuit wiring of the wiring board and the wiring cable.

In view of the above, Patent Document 1 discloses a configuration in which a wiring board is covered with a casing and a cover member, and a wiring cable is led to the outside through an opening disposed in the cover member.

Patent Document 2 discloses a configuration in which a tubular member covering a surface of a wiring board with a connection terminal disposed thereon is covered with a cap member from a side (upper side) of the wiring board opposite to an ink ejection surface such that the wiring board is not exposed. A wiring cable extending upward from the connection terminal is bent downward near the front of the surface with the connection terminal disposed thereon, and is led to the outside through the space between the tubular member and the cap member.

PRIOR ART DOCUMENT

Patent Document

Patent Document 1: JP 2014-004767 A
Patent Document 2: JP 2016-135560 A

SUMMARY OF THE INVENTION

Problems to be Solved by the Invention

However, according to the configuration of Patent Document 1, ink may flow into the inner side of the cover member from a gap between the opening in the cover member and the wiring cable. If the ink flows down the wiring cable and adheres to a connection terminal, an electrical connection failure occurs.

According to Patent Document 2, although ink is prevented from adhering to the connection terminal, the wiring cable needs to be bent with a small bend radius, and a large bending load is applied to the wiring cable. Therefore, the wiring is easily broken, so that a connection failure due to physical disconnection is likely to occur.

Accordingly, with the related-art configurations described above, it is not possible to reliably prevent the occurrence of a connection failure between the circuit wiring of the wiring board and the wiring cable or in the wiring cable.

An object of the present invention is to provide an inkjet head and an inkjet recording device capable of more reliably preventing the occurrence of a connection failure.

Means for Solving Problems

In order to achieve the above-described object, an invention recited in claim 1 is an inkjet head including:

an ink ejector in which an opening of a nozzle that ejects ink is provided in an ink ejection surface, and which includes an actuating element that performs an operation for ejecting ink from the opening of the nozzle;

a wiring board that is provided with a circuit wiring electrically connected to the actuating element, and is disposed in a direction crossing the ink ejection surface on a side opposite to the ink ejection surface of the ink ejector;

an exterior member that covers the ink ejector and the wiring board while exposing the ink ejection surface of the ink ejector and a part of the wiring board;

a wiring cable that is attached to a connection terminal disposed in an area exposed from the exterior member on one surface of the wiring board so as to be electrically connected to the circuit wiring; and a cover member that covers the area of the wiring board exposed from the exterior member and the connection terminal from a side opposite to the ink ejector of the wiring board, wherein the wiring cable passes through a space between an end face of the wiring board on the side opposite to the ink ejector and the cover member, in the cover member, and is led out of the cover member on a surface side opposite to the one surface of the wiring board.

The invention recited in claim 2 is the inkjet head according to claim 1, wherein the exterior member and the cover member are configured such that a projection provided on one of the exterior member and the cover member fits into a hole or a recess provided in another of the exterior member and the cover member.

The invention recited in claim 3 is the inkjet head according to claim 2, wherein the projection and the hole or the recess are provided in areas of the exterior member and cover member that cover the one surface of the wiring board.

The invention recited in claim 4 is the inkjet head according any one of claims 1 to 3, wherein a clearance that circles around the wiring board is provided between the exterior member and the cover member, at a position that is closer to the ink ejection surface than the connector terminal is.

The invention recited in claim 5 is the inkjet head according any one of claims 1 to 4, wherein the exterior member and the cover member are disposed such that a clearance between the exterior member and the cover member in a direction parallel to the ink ejection surface in a specific cross-section perpendicular to the ink ejection surface is greater at a predetermined second position than at a predetermined first position, the first position being closer to the ink ejection surface than the connection terminal is, the second position being closer to the ink ejection surface than the connection terminal is, and being farther from the ink ejection surface than the first position is.

The invention recited in claim 6 is the inkjet head according any one of claims 1 to 5, wherein a movable range restrictor that restricts a movable range of the wiring cable led out of the cover member is provided on an outer surface of the cover member.

The invention recited in claim 7 is the inkjet head according any one of claims 1 to 6, wherein the wiring cable is led out of the cover member through a clearance between the exterior member and the cover member.

The invention recited in claim 8 is the inkjet head according any one of claims 1 to 6, wherein a through hole is provided in a surface of the cover member opposite to the one surface of the wiring board; and wherein the wiring cable is led out of the cover member through the through hole.

Further, in order to achieve the above-described object, an invention recited in claim 9 is an inkjet recording device including the inkjet head of any one of claims 1 to 8.

Advantageous Effects of Invention

According to the present invention, it is possible to more reliably prevent the occurrence of a connection failure.

EMBODIMENTS FOR CARRYING OUT THE INVENTION

Hereinafter, embodiments of an inkjet head and an inkjet recording device of the present invention will be described with reference to the accompanying drawings.

Figure 1:
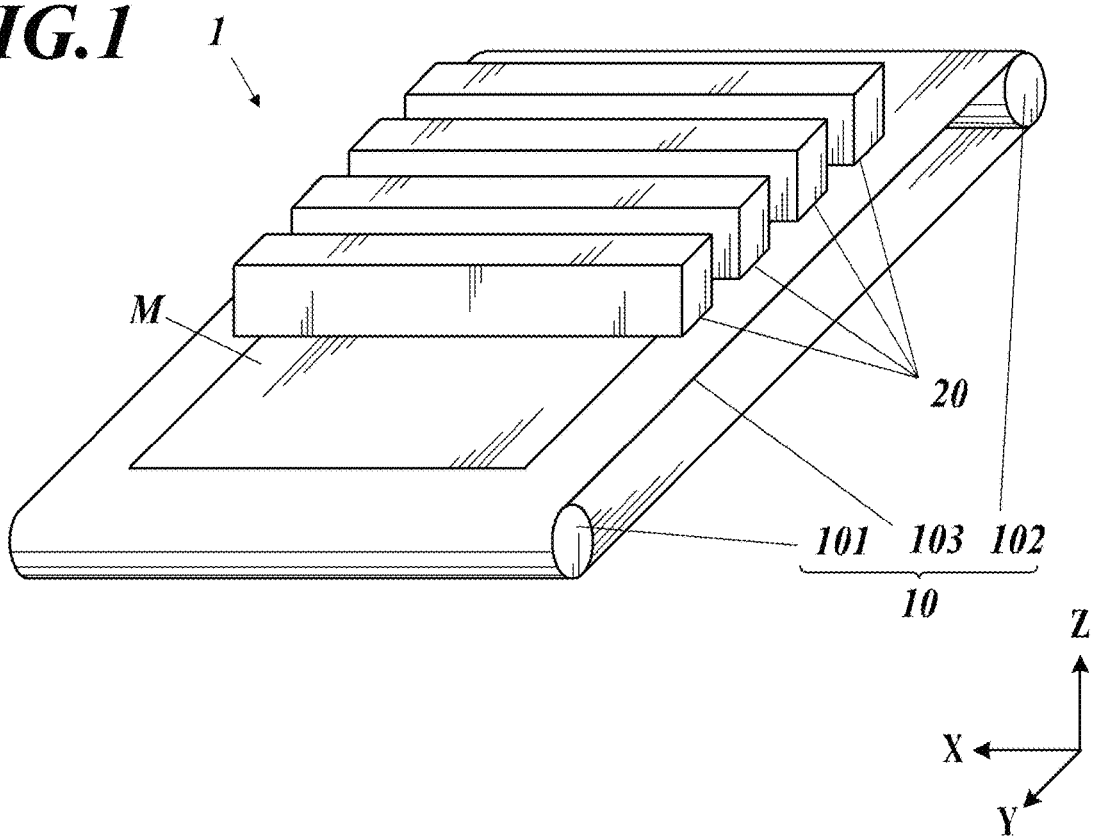
FIG. 1 illustrates the schematic configuration of an inkjet recording device.

FIG. 1 illustrates the schematic configuration of an inkjet recording device 1 according to an embodiment of the present invention.

The inkjet recording device 1 includes a conveyer 10, and head units 20.

The conveyer 10 includes a circular conveyance belt 103 supported at its inner side by two conveyance rollers 101 and 102, each of which rotates about a rotational axis extending in the direction X in FIG. 1. The conveyer 10 conveys a recording medium M in the moving direction of the conveyance belt 103 (conveyance direction; Y direction in FIG. 1) as the conveyance belt 103 circulates, with the recording medium M placed on the conveyance face of the conveyance belt 103, in accordance with rotation of the conveyance roller 101 in response to the operation of a non-illustrated motor. In the following description, the −Y direction is referred to also as the front side; the −Y direction is referred to also as the rear side; the +Z direction in FIG. 1 perpendicular to the XY plane is referred to also as the upper side; and the −Z direction is referred to also as the lower side.

The recording medium M may be a sheet cut to a certain size. The recording medium M is fed to the conveyance belt 103 by a non-illustrated sheet feeder. Then, after an image is recorded with ink ejected from the head units 20, the recording medium M is discharged from the conveyance belt 103 to a predetermined paper discharge part. Note that the recording medium M may be rolled paper. Further, the recording medium M may be any of various types of media having a surface on which ejected ink can be fixed, such as fabric and resin sheets, in addition to paper such as plain paper and coated paper.

The head units 20 record an image by ejecting ink on the recording medium M being conveyed by the conveyer 10 at appropriate timings, based on image data. In the inkjet recording device 1 of the present embodiment, four head units 20 respectively corresponding to inks of four colors of yellow (Y), magenta (M), cyan (C), and black (K) are arranged at predetermined intervals in the order of Y, M, C, and K from the upstream side in the conveyance direction of the recording medium M. Note that the number of head units 20 may be three or less, or five or more.

Figure 2:
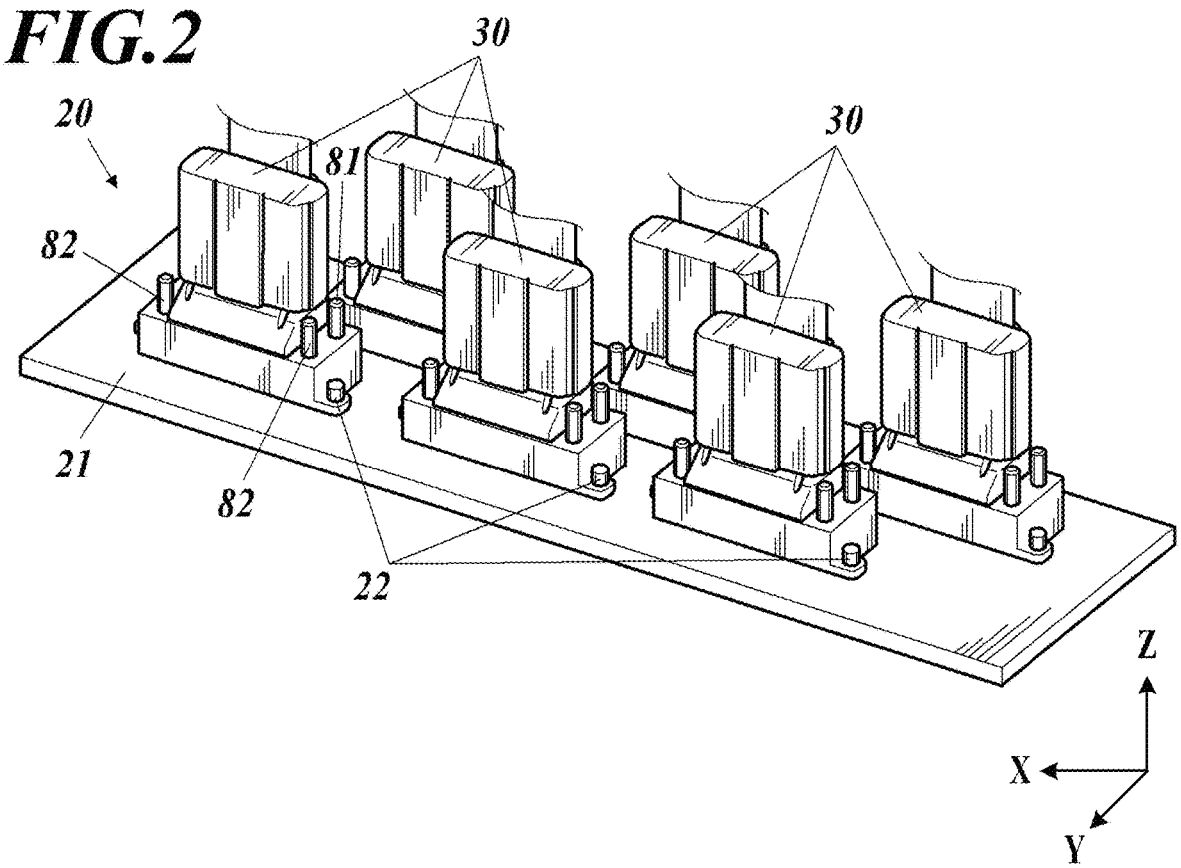
FIG. 2 is a perspective view illustrating the internal configuration of a head unit.

FIG. 2 is a perspective view illustrating the internal configuration of the head unit 20.

The head unit 20 includes a holding substrate 21, and a plurality of (six in this example) inkjet heads 30, each of which is fitted into a through hole in the holding substrate 21 and is fixed to the holding substrate 21 by a fixing member 22.

Each inkjet head 30 includes a plurality of nozzles that eject ink and that are arranged in a direction crossing the conveyance direction of the recording medium M (a width direction, i.e., the X direction orthogonal to the conveyance direction, in the present embodiment). Each inkjet head 30 has a plurality of (e.g., four) nozzle arrays arranged in one dimension in the X direction. The plurality of nozzle arrays are disposed such that positions of the nozzles are offset from each other in the X direction.

The inkjet head 30 has an inlet 81 through which ink to be supplied into the inkjet head 30 flows in, and an outlet 82 through which ink to be discharged from the inkjet head 30 flows out.

The six inkjet heads 30 of each head unit 20 are arranged in a staggered manner such that the arrangement area of the nozzles in the X direction extends across the width of an image recordable area of the recording medium M in the X direction on the conveyance belt 103. Since the inkjet heads 30 are arranged in the manner described above, the inkjet recording device 1 ejects ink from the inkjet heads 30 of the stationary head units 20 at appropriate timings in accordance with image data, and thereby can record an image on the recording medium M being conveyed. That is, the inkjet recording device 1 records an image using a single-pass system.

Figure 3:
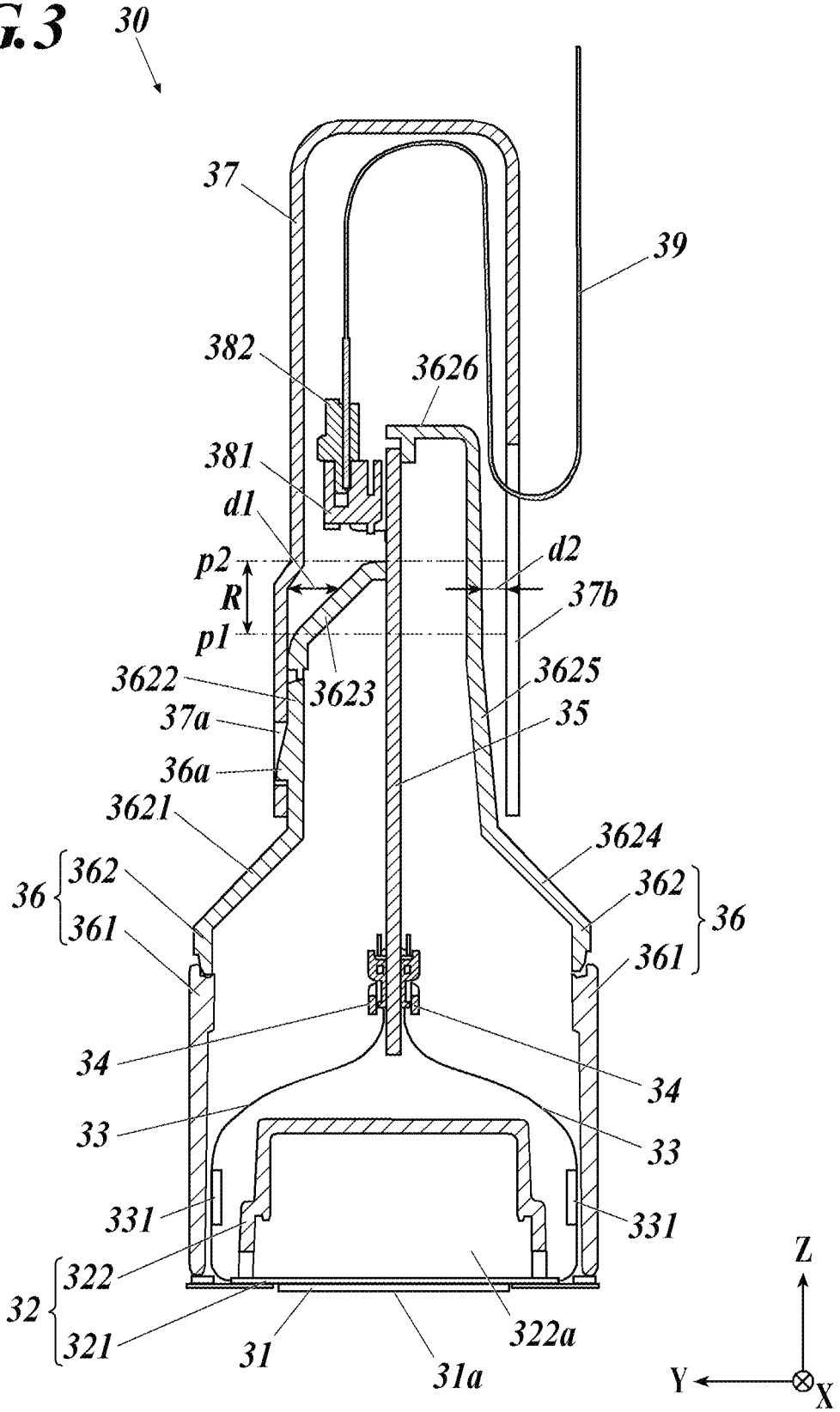
FIG. 3 is a cross-sectional view illustrating the configuration of an inkjet head.

FIG. 3 is a cross-sectional view illustrating the configuration of the inkjet head 30. FIG. 3 is a cross-sectional view in a plane perpendicular to the X direction at the center portion of the inkjet head 30 in the X direction.

The inkjet head 30 includes a head chip 31 (ink ejector) that ejects ink from an opening of a nozzle provided in an ink ejection surface 31*a*, an ink supplier 32 that includes an ink reservoir 322 for reserving ink flowing in through the inlet 81 and a holding substrate 321, and that supplies ink to the head chip 31, wiring members 33 connected to the head chip 31, a wiring board 35 that is disposed in the Z direction and to which the wiring members 33 are connected via first connectors 34, an exterior member 36 that covers the head chip 31 and the wiring board 35 while exposing the ink ejection surface 31*a* of the head chip 31 and a part of one surface of the wiring board 35, a wiring cable 39 that is electrically connected to a circuit wiring of the wiring board 35 by being attached to a second connector 381 (connection terminal) disposed on the surface of the wiring board 35 exposed from the exterior member 36, and a cover member 37 that covers the wiring board 35 and a part of the exterior member 36 from the upper side in FIG.

Figure 4:
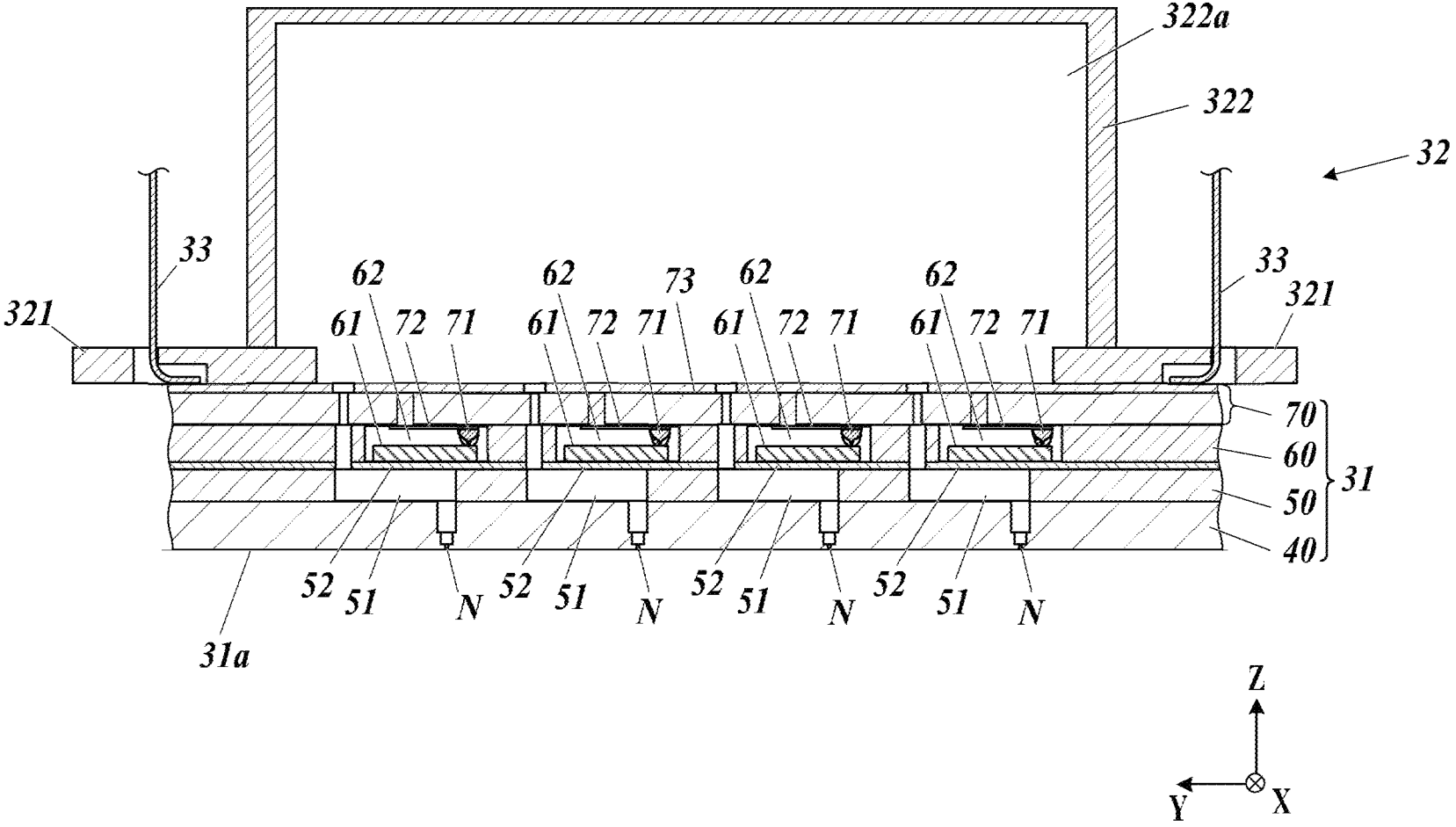
FIG. 4 is a schematic enlarged cross-sectional view illustrating a head chip and an ink supplier.

FIG. 4 is a schematic enlarged cross-sectional view illustrating the head chip 31 and the ink supplier 32. FIG. 4 illustrates a cross-section including four nozzles N of the head chip 31 respectively included in the four nozzle arrays.

The head chip 31 is a structure for ejecting ink from the nozzles N, and includes a plurality of, four in this example, stacked plate-shaped substrates. The lowermost substrate of the head chip 31 is a nozzle substrate 40. The nozzle substrate 40 is provided with a plurality of nozzles N, and is configured such that ink can be ejected substantially perpendicularly with respect to an exposed surface (ink ejection surface 31*a*) of the nozzle substrate 40 from openings of the nozzles N. A pressure chamber substrate 50 (chamber plate), a spacer substrate 60, and a wiring forming substrate 70 are sequentially bonded and stacked upward in this order on the side of the nozzle substrate 40 opposite to the ink ejection surface 31*a*. The nozzle substrate 40, the pressure chamber substrate 50, the spacer substrate 60, and the wiring forming substrate 70 are hereinafter also referred to collectively or individually as laminated substrates 40, 50, 60, and 70.

Ink channels communicating with the nozzles N are provided in these laminated substrates 40, 50, 60, and 70. The ink channels are open at the exposed-side (upper) surface of the wiring forming substrate 70. A common ink chamber 322*a* defined by the ink reservoir 322 is formed on the exposed surface of the wiring forming substrate 70 so as to extend across all the openings. The ink reserved in the common ink chamber 322*a* is supplied from the openings in the wiring forming substrate 70 to the nozzles N.

A pressure chamber 51 is provided midway of each ink channel. The pressure chamber 51 is provided to vertically extend through the pressure chamber substrate 50. The upper surface of the pressure chamber 51 is defined by a diaphragm 52 disposed between the pressure chamber substrate 50 and the spacer substrate 60. When the diaphragm 52 (pressure chamber 51) is deformed in response to a displacement (deformation) of a piezoelectric element 61 (actuating element) in a storage 62 that is disposed next to the pressure chamber 51 with the diaphragm 52 interposed therebetween, a pressure change is applied to the ink in the pressure chamber 51. When an appropriate pressure change is applied to the ink in the pressure chamber 51, the ink in the ink channel is ejected in the form of droplets from the nozzle N communicating with the pressure chamber 51. The head chip 31 is a substrate in which the piezoelectric elements 61 serving as actuators are disposed, and therefor is called also as an actuator substrate.

Although not illustrated in FIG. 3, a liquid discharge channel for guiding the ink in the ink channels to the outlet 82 and discharging the ink is provided in the head chip 31.

The holding substrate 321 is joined to the upper surface of the head chip 31, and holds the ink reservoir 322. The holding substrate 321 has an opening of substantially the same size as the opening in the lower surface of the ink reservoir 322 such that the ink in the common ink chamber 322*a* is supplied to the upper surface of the head chip 31 through the opening in the lower surface of the ink reservoir 322 and the opening in the holding substrate 321.

The wiring members 33 are, for example, flexible printed circuit (FPC), and are connected to a wiring layer 73 on the surface of the wiring forming substrate 70. The piezoelectric element 61 is displaced in response to a drive signal transmitted through the wiring layer 73 to a wiring 72 and a connection part 71 in the storage 62. The wiring members 33 extend through the holding substrate 321, one from the front side (+Y direction side) and the other from the rear side (−Y direction side) of the head chip 31. As illustrated in FIG. 3, the paired wiring members 33 are respectively connected via the first connectors 34 respectively provided on a front-side surface (one surface) (hereinafter also referred to as a front surface) and a rear-side surface (hereinafter also referred to as a rear surface) of the wiring board 35 to a circuit wiring on the front surface and a circuit wiring on the rear surface of the wiring board 35.

As illustrated in FIG. 3, drivers 331 are mounted, one on each of the inner (ink-supplier-32-side) surfaces of the paired wiring members 33. The drivers 331 receive a control signal from a controller of the inkjet recording device 1 and power supplied from a power supply, and output appropriate drive signals for the piezoelectric elements 61 to the wirings on the wiring members 33, in accordance with an ink ejection operation and a non-ejection operation from the nozzles N. Each of the drivers 331 includes an integrated circuit (IC) or the like.

As illustrated in FIG. 3, the wiring board 35 is fixed to the exterior member 36 on the upper side of the head chip 31 and the ink supplier 32 so as to be disposed in a direction crossing the ink ejection surface 31*a* of the head chip 31 (a perpendicular direction perpendicular to the ink ejection surface 31*a*, i.e., the +Z direction, in the present embodiment). The wiring board 35 is a rigid board in which a metal circuit wiring is formed on the surface of an insulating base material such as a glass epoxy substrate. The wiring board 35 may be flexible as long as the wiring board 35 can be stably fixed to the exterior member 36.

The first connectors 34 described above are disposed on both surfaces of the wiring board 35 in the vicinity of its lower end, and the second connector 381 is disposed on the front surface in the vicinity of its upper end. The circuit wiring on the rear surface of the wiring board 35 connected to the first connector 34 on the rear surface is electrically connected to the circuit wiring on the front surface through a through hole or the like, and thus is connected to the second connector 381.

The exterior member 36 has a structure obtained by assembling and fixing a lower part 361 to which the head chip 31 and the ink supplier 32 are fixed and an upper part 362 that is disposed on the upper side of the lower part 361 and to which the wiring board 35 is fixed.

The lower part 361 of the exterior member 36 is a substantially tubular member that has a substantially rectangular shape in the cross-section perpendicular to the Z direction and that covers, with its four sides, the sides of the head chip 31 and the ink supplier 32 such that the ink ejection surface 31*a* of the head chip 31 is exposed downward. The holding substrate 321 of the ink supplier 32 is fixed to the lower part 361. Accordingly, the head chip 31 attached to the lower surface of the holding substrate 321 is indirectly fixed to the lower part 361 of the exterior member 36 with the holding substrate 321 interposed therebetween. Note that the head chip 31 may be directly connected to the lower part 361.

The upper part 362 of the exterior member 36 is connected to the opening on the upper side of the lower part 361, and has a shape such that the Y-direction width of the cross-section perpendicular to the Z direction decreases in the direction away from the lower part 361. More specifically, the front portion of the upper part 362 includes a first inclined portion 3621 inclined inwardly (rearwardly) from the portion connected to the lower part 361, a front vertical portion 3622 extending substantially vertically on the upper side of the first inclined portion 3621, and a second inclined portion 3623 inclined further inwardly on the upper side of the front vertical portion 3622. The rear portion of the upper part 362 includes a third inclined portion 3624 inclined inwardly (forwardly) from the portion connected to the lower part 361, a rear-surface portion 3625 inclined slightly upwardly and inwardly on the upper side of the third inclined portion 3624, and an upper-surface portion 3626 extending forward from the upper end of the rear-surface portion 3625 to define the upper surface. Each portion of the front side and rear side of the upper part 362 is connected to a pair of side surfaces that are inclined slightly upwardly and inwardly. A projection 36*a* that fits into a below-described hole 37*a* of the cover member 37 is provided on the outer surface of the front vertical portion 3622.

The upper end of the front portion of the upper part 362, that is, the upper end of the second inclined portion 3623 is in contact with the front surface of the wiring board 35 to support the wiring board 35. The upper end of the rear portion of the upper part 362, that is, the end of the upper-surface portion 3626 is in contact with the upper end of the rear surface of the wiring board 35 to support the wiring board 35. The upper end of the second inclined portion 3623 is located below the end of the upper-surface portion 3626, and the area of the front surface of the wiring board 35 above the portion in contact with the second inclined portion 3623 is exposed from the upper part 362 (i.e., from the exterior member 36). The second connector 381 is fixed to the exposed area of the front surface of the wiring board 35.

Examples of the material of the lower part 361 and the upper part 362 of the exterior member 36 include, but not limited to, various types of resin, such as PPS resin having excellent mechanical strength and chemical resistance against ink, metal, and alloy.

The lower part 361 and the upper part 362 may be integrally formed.

The wiring cable 39 is electrically connected to the second connector 381 exposed from the exterior member 36, via an aid 382.

The wiring cable 39 is a flexible cable in which a plurality of wires each covered with insulating resin are integrally joined by the resin. The wiring cable 39 receives, from the outside, a control signal to be supplied to the drivers 331 on the wiring members 33.

The aid 382 is attached to an end of the wiring cable 39, and fits to the second connector 381 to fix the wiring cable 39 to the second connector 381 such that the terminals of the second connector 381 and the lines of the wiring cable 39 are electrically connected. The aid 382 is configured to be fixed to the second connector 381 in an orientation such that the wiring cable 39 extends upward from the second connector 381.

Figure 5:
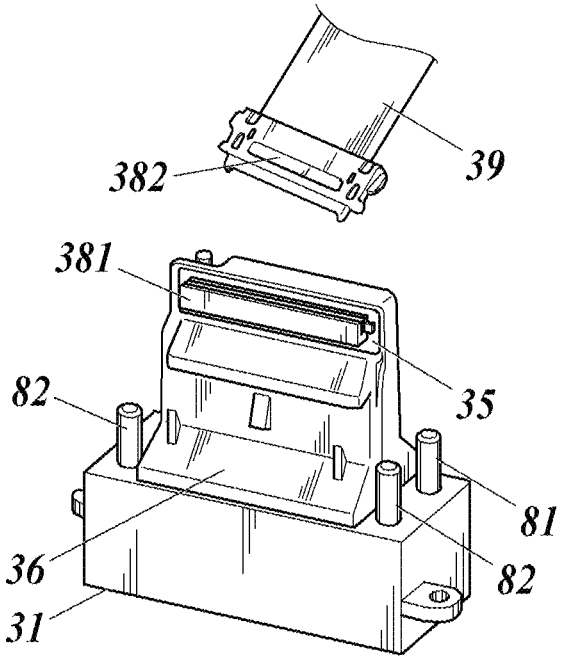
FIG. 5 is a perspective view illustrating how a wiring cable is connected to a second connector.

FIG. 5 is a perspective view illustrating how the wiring cable 39 is connected to the second connector 381.

As illustrated in FIG. 5, the aid 382 attached to the end of the wiring cable 39 is attached to the second connector 381 from the upper side of the second connector 381, so that the wiring cable 39 and the second connector 381 are connected.

As illustrated in FIG. 3, the cover member 37 is a member of a substantially rectangular solid shape with an open bottom that covers the wiring board 35 and a part of the exterior member 36 from the side (the upper side in FIG. 3) of the wiring board 35 opposite to the head chip 31 such that the area of the wiring board 35 exposed from the exterior member 36 (i.e., the area around the upper end of the front surface) and the second connector 381 are not exposed to the outside. Specifically, the cover member 37 covers the wiring board 35 and a part of the exterior member 36 such that there is no linear path that directly leads from the outside of the inkjet head 30 to the wiring board 35 and the second connector 381.

As in the case of the exterior member 36, examples of the material of the cover member 37 include, but not limited to, various types of resin, such as PPS resin having excellent mechanical strength and chemical resistance against ink, metal, and alloy.

In the cover member 37, the wiring cable 39 passes through the upper end side of the wiring board 35 (the space between the end face of the wiring board 35 opposite to the head chip 31 and the cover member 37) so as to be routed to the side opposite to the surface on which the second connector 381 is disposed (that is, the rear side of the wiring board 35). Further, the wiring cable 39 is led out of the cover member 37 from the space between the exterior member 36 and the cover member 37 on the rear side of the wiring board 35, and then routed upward at the outside of the cover member 37.

Figure 6:
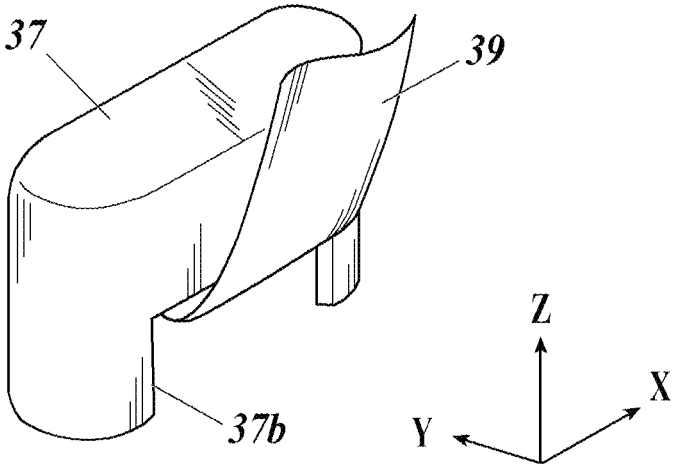
FIG. 6 is a perspective view illustrating a rear side of a cover member.

As illustrated in FIG. 6, a rectangular notch 37*b* is formed from the lower end on the rear side of the cover member 37, and the wiring cable 39 is led to the outside through the notch 37*b*. With the provision of the notch 37*b*, the distance that the wiring cable 39 is routed inside the cover member 37 can be reduced. Note that the cover member 37 does not have to have the notch 37*b*.

Figure 7A:
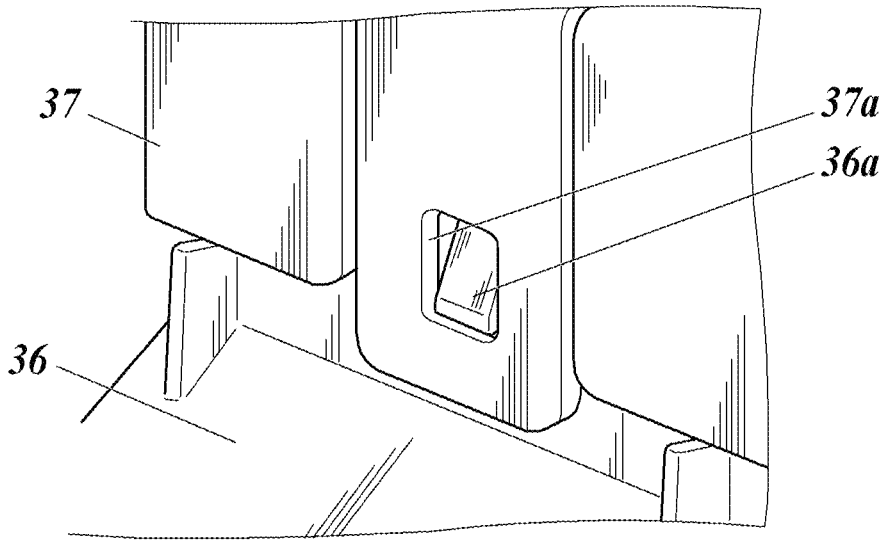
FIG. 7A is a perspective view illustrating a fitting portion between an exterior member and a cover member.
Figure 7B:
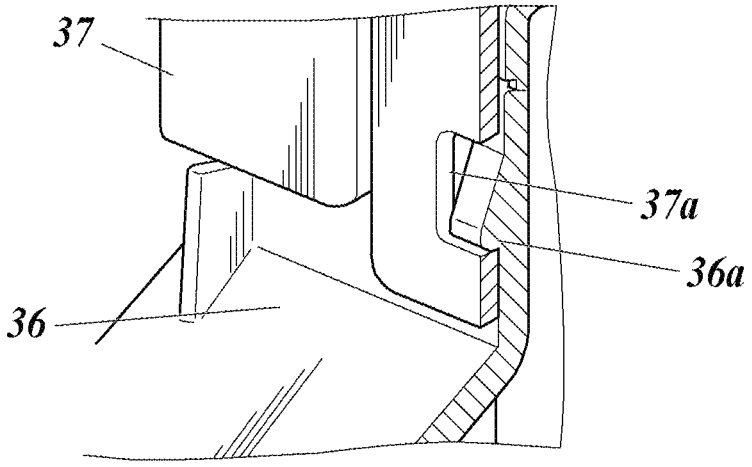
FIG. 7B illustrates a cross-section of the fitting portion of FIG. 7A.

Further, as illustrated in FIG. 3, the hole 37*a* extending through the cover member 37 is provided near the lower end of the front surface of the cover member 37. As illustrated in the enlarged perspective view of FIG. 7A and the perspective cross-sectional view of FIG. 7B, when the projection 36*a* of the exterior member 36 fits into the hole 37*a*, the exterior member 36 and the cover member 37 are assembled and fixed by snap fitting. Further, since a fitting portion formed by the projection 36*a* and the hole 37*a* is provided in the area of the exterior member 36 and the cover member 37 covering the front surface of the wiring board 35, the cover member 37 is less easily removed from the exterior member 36 when the wiring cable 39 is pulled up at the outside of the cover member 37 and a force of pulling up is applied from the wiring cable 39 to the rear side of the cover member 37.

Note that a fitting portion may be formed by providing a projection on the inner surface of the cover member 37 and a hole in the exterior member 36. Alternatively, a recess that does not extending through the cover member 37 (exterior member 36) may be provided in place of the hole 37*a*, such that the projection 36*a* is fitted into the recess.

Figure 8:
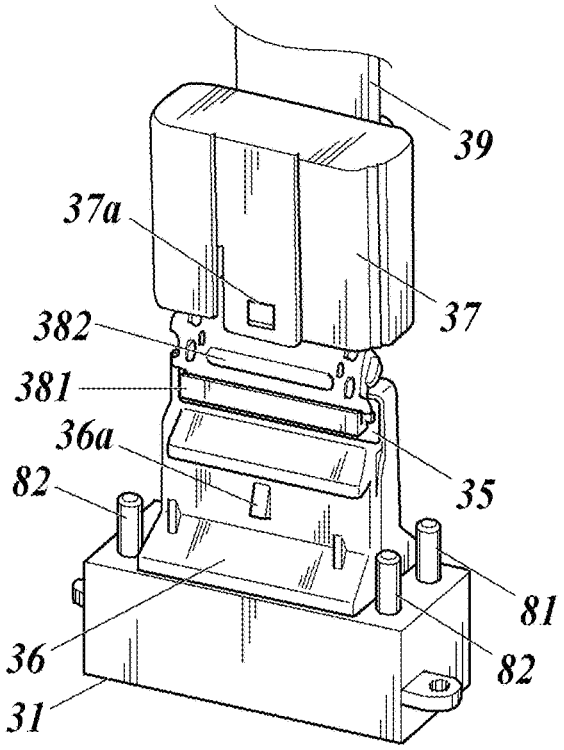
FIG. 8 is a perspective view illustrating how the cover member is put over the exterior member and a wiring board from the upper side.

FIG. 8 is a perspective view illustrating how the cover member 37 is put over the exterior member 36 and the wiring board 35 from the upper side.

As illustrated in FIG. 8, the cover member 37 is put over the wiring board 35 with the wiring cable 39 attached to the second connector 381, from the upper side. Then, the cover member 37 is moved down to a position where the projection 36*a* of the exterior member 36 fits into the hole 37*a* of the cover member 37. Thus, the projection 36*a* fits into the hole 37*a*, so that the cover member 37 is attached to the exterior member 36.

Figure 9:
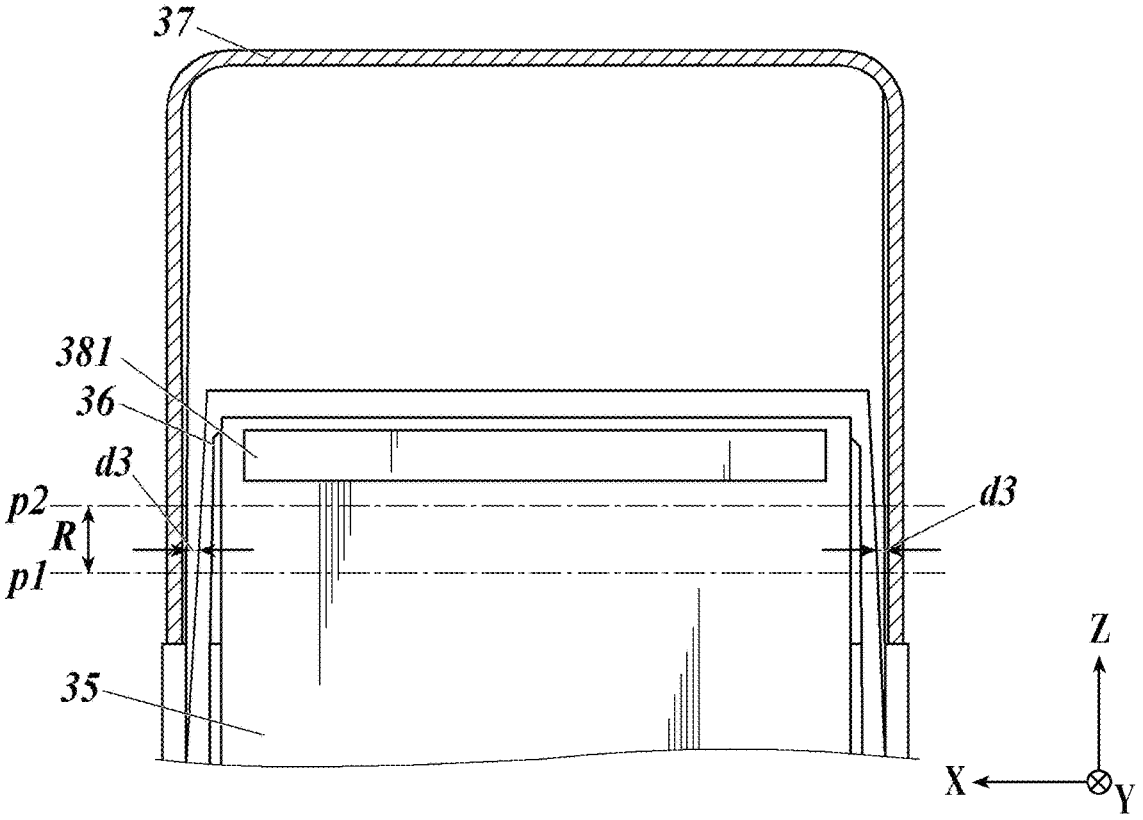
FIG. 9 illustrates a portion around a second connector of the inkjet head as viewed from the +Y direction.

The inkjet head 30 has a clearance d (clearances d1 to d3) between the exterior member 36 and the cover member 37. The clearance d circles around the wiring board 35, at a position that is closer to the ink ejection surface 31*a* than the second connector 381 is (on the ink ejection surface 31*a* side with respect to the second connector 381 in the Z direction). Specifically, as illustrated in FIG. 3, the clearance d1 is provided between the exterior member 36 and the cover member 37 on the front side of the wiring board 35, and the clearance d2 is provided between the exterior member 36 and the cover member 37 on the rear side of the wiring board 35, in a range R on the lower side of the second connector 381 in the Z direction. Further, as illustrated in FIG. 9, the clearance d3 is provided between the exterior member 36 and the cover member 37, on both the lateral sides of the wiring board 35 in the range R. Note that FIG. 9 is a view of a portion around the second connector 381 of the inkjet head 30 as viewed from the +Y direction, in which the front portions of the exterior member 36 and the cover member 37 are illustrated as being transparent for explanation purposes.

Further, as illustrated in FIG. 3, the exterior member 36 and the cover member 37 are disposed such that the clearance d (clearances d1 and d2 in FIG. 3, clearance d3 in FIG. 9) in the direction parallel to the ink ejection surface 31*a* (Y direction in FIG. 3, and X direction in FIG. 9) in a specific cross-section perpendicular to the ink ejection surface 31*a* is greater at a predetermined second position p2 than at a predetermined first position p1. The first position p1 is closer to the ink ejection surface 31*a* than the second connector 381 is. The second position p2 is closer to the ink ejection surface 31*a* than the second connector 381 is, and is farther from the ink ejection surface 31*a* than the first position p1 is. The first position p1 is the lower end position of the range R, and the second position p2 is the upper end position of the range R. In particular, the exterior member 36 and the cover member 37 of the present embodiment are provided such that the clearance d between the exterior member 36 and the cover member 37 in the direction parallel to the ink ejection surface 31*a* gradually increases as the distance from the ink ejection surface 31*a* increases. That is, in the range R on the front side of the wiring board 35, since the exterior member 36 is inclined inwardly at the second inclined portion 3623, the width of the clearance d1 between the exterior member 36 and the cover member 37 increases in the +Z direction (from the first position p1 to the second position p2). Further, in the range R on the rear side of the wiring board 35, since the exterior member 36 is inclined slightly inwardly at the rear-surface portion 3625, the width of the clearance d2 between the exterior member 36 and the cover member 37 increases in the +Z direction (from the first position p1 to the second position p2). Further, as illustrated in FIG. 9, in the range R on the lateral sides of the wiring board 35, since the side surfaces of the exterior member 36 are slightly inclined inwardly, the width of the clearance d3 between the exterior member 36 and the cover member 37 increases toward the +Z direction (from the first position p1 to the second position p2).

Since the clearances d1 to d3 between the exterior member 36 and the cover member 37 are provided in the manner described above, even if ink flows from the lower end of the cover member 37 into the space between the exterior member 36 and the cover member 37, it is possible to prevent the ink from flowing up due to the capillary phenomenon. As a result, it is possible to prevent the occurrence of an electrical connection failure between the wiring of the wiring board 35 and the wiring cable 39 due to adhesion of the ink that has flowed therein to a portion of the second connector 381 connected to the wiring cable 39.

Modification 1

In the following, Modification 1 of the above embodiment will be described. The present modification is different from the above embodiment in that a movable range restrictor 37*c* that restricts the movable range of the wiring cable 39 is provided on the back surface of the cover member 37.

Figure 10A:
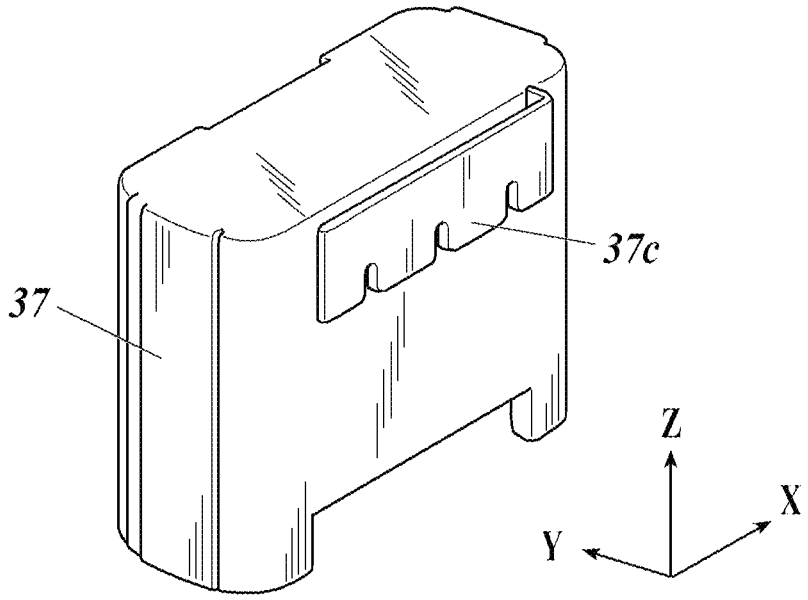
FIG. 10A is a perspective view illustrating a first example of a movable range restrictor.

FIG. 10A is a perspective view illustrating a first example of the movable range restrictor 37*c*. This movable range restrictor 37*c* is a clip fixed to the back surface of the cover member 37 so as to be urged against the cover member 37.

Figure 11:
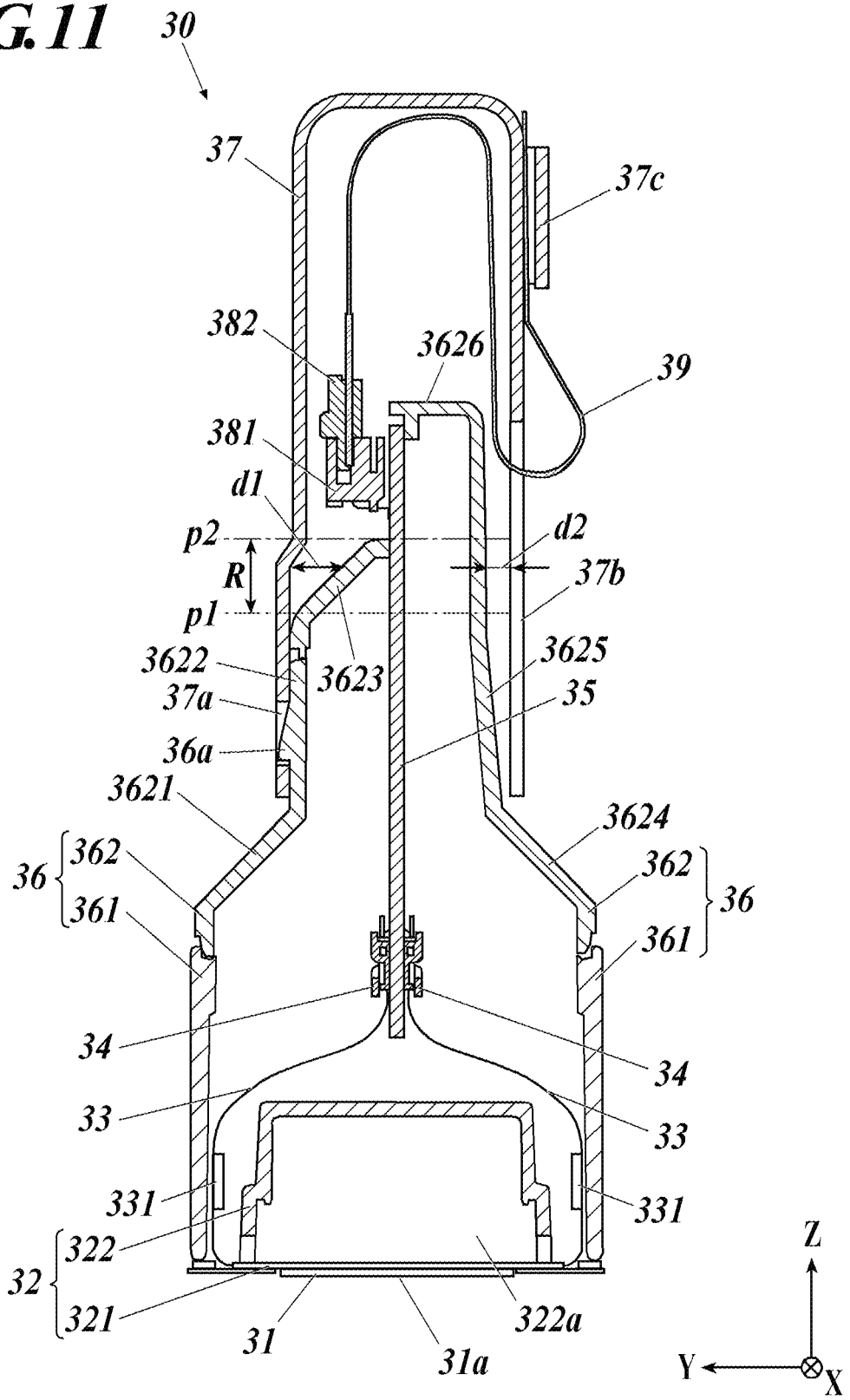
FIG. 11 is a cross-sectional view illustrating the configuration of an inkjet head according to Modification 1.

FIG. 11 is a cross-sectional view illustrating the configuration of the inkjet head 30 according to the present modification. Specifically, FIG. 11 illustrates a cross-section of the inkjet head 30 in which the wiring cable 39 is fixed by the movable range restrictor 37*c*. As illustrated in FIG. 11, the wiring cable 39 passes between the back surface of the cover member 37 and the movable range restrictor 37*c*, so that the wiring cable 39 is urged against the back surface of the cover member 37 by the movable range restrictor 37*c*. Accordingly, it is possible to prevent a large load from being applied to a portion of the wiring cable 39 extending forward from the fixed position (portion on the second connector 381 side).

Figure 10B:
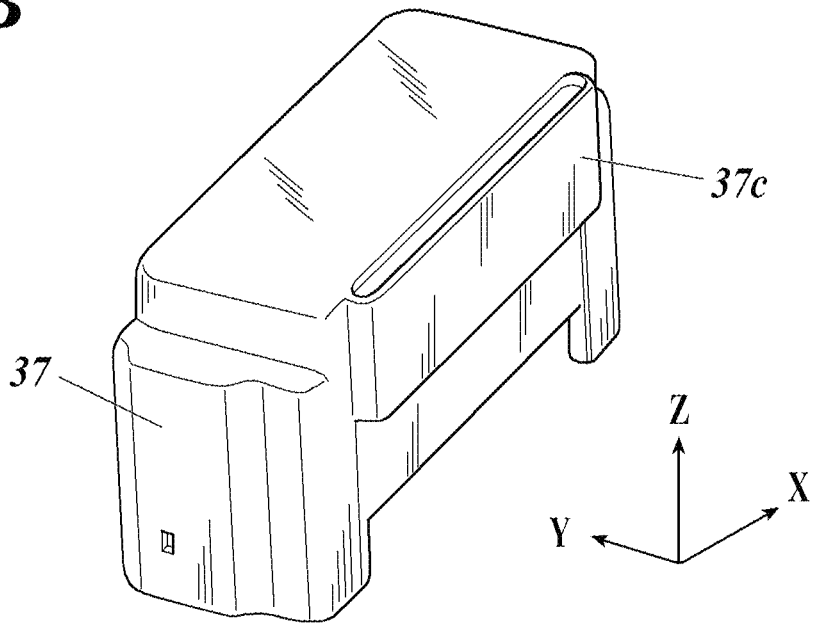
FIG. 10B is a perspective view illustrating a second example of a movable range restrictor.

FIG. 10B is a perspective view illustrating a second example of the movable range restrictor 37*c*. This movable range restrictor 37*c* is a plate member fixed to the back surface of the cover member 37 such that a hole through which the wiring cable 39 passes is formed between the back surface of the cover member 37 and the movable range restrictor 37*c*. As illustrated in FIG. 11, the wiring cable 39 passes between the back surface of the cover member 37 and the movable range restrictor 37*c*. Accordingly, with this movable range restrictor 37*c* as well, it is possible to prevent a large load from being applied to a portion of the wiring cable 39 extending forward from the fixed position.

Modification 2

In the following, Modification 2 of the above embodiment will be described. The present modification may be combined with Modification 1 described above. The present modification is different from the above embodiment in the configuration of the cover member 37 and the manner in which the wiring cable 39 is led out of the cover member 37.

Figure 12:
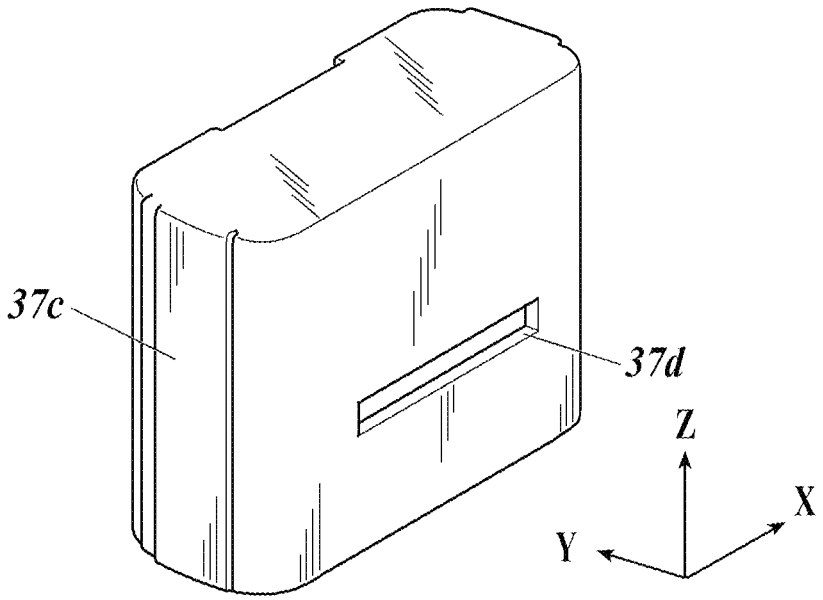
FIG. 12 is a perspective view of a cover member according to Modification 2 as viewed from a back side.

FIG. 12 is a perspective view of the cover member 37 according to the present modification as viewed from the back side.

Figure 13:
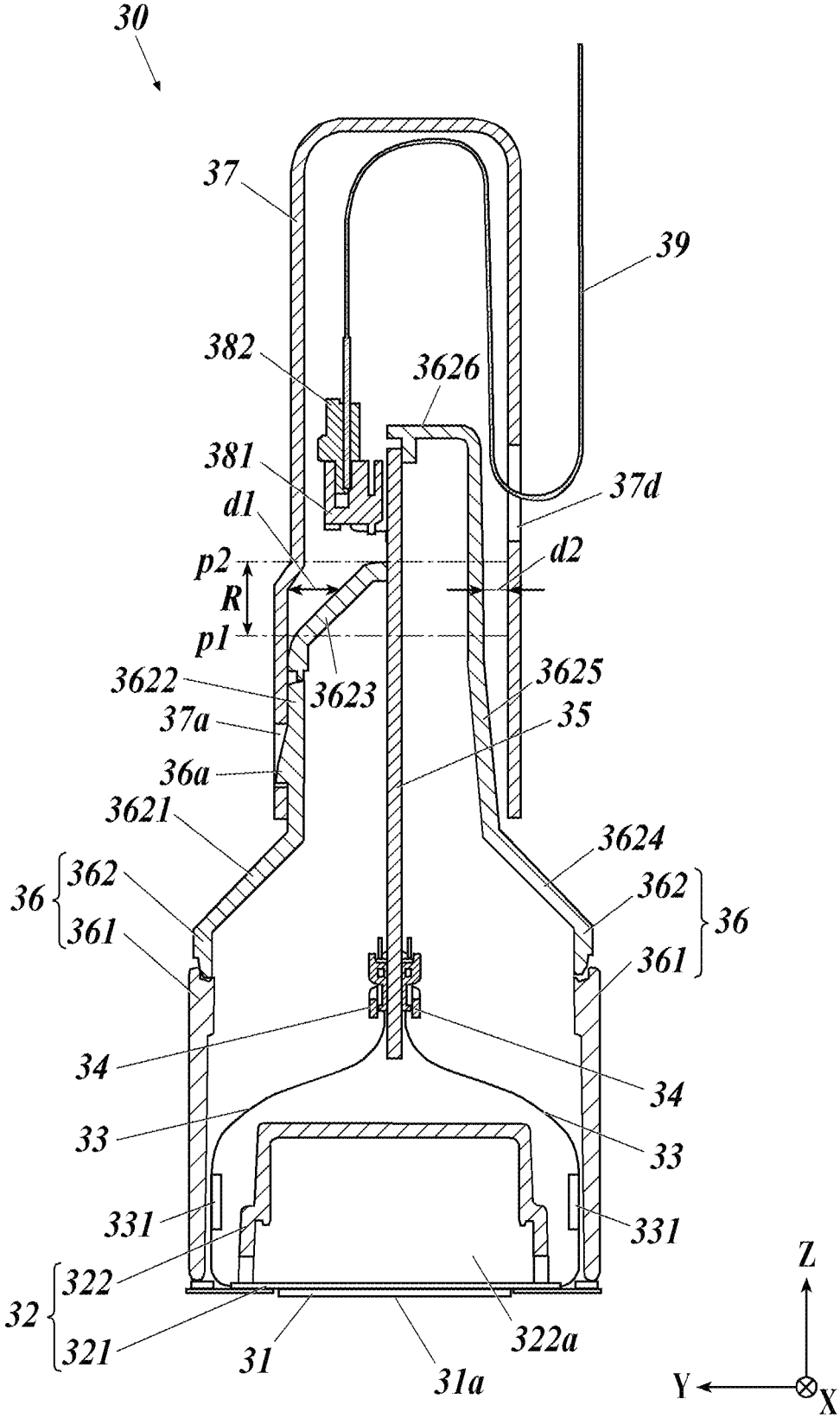
FIG. 13 is a cross-sectional view illustrating the configuration of an inkjet head according to Modification 2.

FIG. 13 is a cross-sectional view illustrating the configuration of the inkjet head 30 according to the present modification.

As illustrated in FIG. 12, a horizontally elongated through hole 37*d* extending in the X direction is provided in the back surface of the cover member 37 of the present modification, in place of the notch 37*b*. The through hole 37*d* is formed in such a position that there is no linear path that directly leads from the outside of the inkjet head 30 to the wiring board 35 and the second connector 381 through the through hole 37*d*.

Further, as illustrated in FIG. 13, the wiring cable 39 passes through the upper end side of the wiring board 35 in the cover member 37 so as to be routed to the rear side of the wiring board 35, and then is led out of the cover member 37 through the through hole 37*d*. With this configuration as well, the wiring cable 39 can be led out of the cover member 37 while reducing the distance that the wiring cable 39 is routed inside the cover member 37.

As described above, the inkjet head 30 according to the present embodiment includes: the head chip 31 in which the opening of the nozzle N that ejects ink is provided in the ink ejection surface 31*a*, and which includes the piezoelectric element 61 that performs an operation for ejecting ink from the opening of the nozzle N; the wiring board 35 that is provided with the circuit wiring electrically connected to the piezoelectric element 61, and is disposed in the Z direction on the side opposite to the ink ejection surface 31*a* of the head chip 31; the exterior member 36 that covers the head chip 31 and the wiring board 35 while exposing the ink ejection surface 31*a* of the head chip 31 and a part of the wiring board 35; the wiring cable 39 that is attached to the second connector 381 disposed in an area exposed from the exterior member 36 on the front surface of the wiring board 35 so as to be electrically connected to the wiring board 35; and the cover member 37 that covers the area of the wiring board 35 exposed from the exterior member 36 and the second connector 381 from the upper end side of the wiring board 35; wherein the wiring cable 39 passes through the space between the end face of the wiring board 35 on the side opposite to the head chip 31 and the cover member 37, in the cover member 37, and is led out of the cover member 37 on the rear side of the wiring board 35.

According to this configuration, the wiring cable 39 passes through the upper end side of the wiring board 35 from the second connector 381 on the front side of the wiring board 35 so as to be routed to the rear side, and then is led to the outside from the lower end side of the cover member 37. Therefore, compared to the related-art configuration in which the wiring cable is bent downward near the front of the surface of the wiring board with the connector disposed thereon and is led to the outside, the minimum radius of curvature of the wiring cable 39 can be increased. Accordingly, the bending load on the wiring cable 39 can be reduced by routing the wiring cable 39 in a reasonable layout, and it is therefore possible to prevent the occurrence of defects such as breakage of the wiring and rapid deterioration.

Further, since the wiring board 35 and the second connector 381 on the wiring board 35 are covered with the exterior member 36 and the cover member 37 so as not to be exposed, it is possible to prevent the occurrence of an electrical connection failure due to adhesion of ink to the connection portion between the second connector 381 and the wiring cable 39.

The exterior member 36 and the cover member 37 are configured such that the projection 36*a* provided on the exterior member 36 fits into the hole 37*a* provided in the cover member 37. Accordingly, the cover member 37 can easily be attached to and removed from the exterior member 36 with a simple configuration.

The projection 36*a* and the hole 37*a* are respectively provided in the areas of the exterior member 36 and cover member 37 that cover the front surface of the wiring board 35. Accordingly, when the wiring cable 39 outside the cover member 37 is pulled up and a force of pulling up the wiring cable 39 is applied to the cover member 37 on the rear side of the wiring board 35, the cover member 37 is less likely to be removed from the exterior member 36.

Further, the clearances d1 to d3 that circle around the wiring board 35 are provided between the exterior member 36 and the cover member 37, at a position that is closer to the ink ejection surface 31*a* than the second connector 381 is. Accordingly, even if ink flows from the lower end of the cover member 37 into the space between the exterior member 36 and the cover member 37, it is possible to prevent the ink from flowing up due to the capillary phenomenon. As a result, it is possible to more reliably prevent the occurrence of an electrical connection failure between the wiring of the wiring board 35 and the wiring cable 39 due to adhesion of the ink that has flowed therein to a portion of the second connector 381 connected to the wiring cable 39.

The exterior member 36 and the cover member 37 are disposed such that the clearance d between the exterior member 36 and the cover member 37 in the direction parallel to the ink ejection surface 31*a* in a specific cross-section perpendicular to the ink ejection surface 31*a* is greater at the predetermined second position p2 than at the predetermined first position p1, wherein the first position p1 is closer to the ink ejection surface 31*a* than the second connector 381 is, and the second position p2 is closer to the ink ejection surface 31*a* than the second connector 381 is, and is farther from the ink ejection surface 31*a* than the first position p1 is. With this configuration, the ink that has flowed into the clearance d between the exterior member 36 and the cover member 37 is prevented from flowing upward to the second position p2. Accordingly, it is possible to more reliably prevent the occurrence of an electrical connection failure.

Further, in the inkjet head 30 according to Modification 1 described above, the movable range restrictor 37*c* that restricts the movable range of the wiring cable 39 led out of the cover member 37 is provided on the outer surface of the cover member 37. Accordingly, it is possible to prevent a large load from being applied to a portion of the wiring cable 39 on the second connector 381 side with respect to a restriction position of the movable range by the movable range restrictor 37*c*. It is therefore possible to more reliably prevent the occurrence of defects such as breakage of the wiring and rapid deterioration.

Further, the wiring cable 39 is led out of the cover member 37 through the clearance between the exterior member 36 and the cover member 37. This can simplify the configuration of the cover member 37.

Further, in the inkjet head 30 according to Modification 2 described above, the through hole 37*d* is provided in the cover member 37 on the back side of the wiring board 35, and the wiring cable 39 is led out of the cover member 37 through the through hole 37*d*. With this configuration, the wiring cable 39 can be led to the outside from a desired position on the back side of the cover member 37 while covering a large area of the back side of the exterior member 36 by the cover member 37. Also, the distance that the wiring cable 39 is routed inside the cover member 37 can be reduced.

The inkjet recording device 1 according to the present embodiment includes the inkjet head 30 described above. Accordingly, in the inkjet head 30, it is possible to more reliably prevent the occurrence of a connection failure while minimizing the load applied to the wiring cable 39. This can prevent the failure of the inkjet recording device 1 and the occurrence of an ink ejection failure.

The present invention is not limited to the embodiments and modifications described above, and various changes may be made.

For example, the shape of the exterior member 36 and the cover member 37 is not limited to those described in the embodiments and the modifications.

The exterior member 36 may have any shape as long as the exterior member 36 allows the head chip 31 to be attached such that the ink ejection surface 31*a* is exposed, and covers a part of the wiring board 35 while exposing at least a portion of the wiring board 35 where the second connector 381 is formed.

The cover member 37 may have any shape as long as the cover member 37 covers the wiring board 35 and at least a part of the exterior member 36 from the upper end side of the wiring board 35 such that the area of the wiring board 35 exposed from the exterior member 36 and the second connector 381 are not exposed to the outside.

Further, the exterior member 36 and the cover member 37 may be fixed, for example, by screwing, or by a mechanism using the attractive force, other than the snap-fitting method that fits the projection 36*a* into the hole 37*a*.

In the above embodiments and modifications, the head chip 31 has been illustrated as the ink ejector. However, the configuration of the ink ejector is not limited thereto. The ink ejector may have any configuration that includes the ink ejection surface 31*a* and ejects ink from the nozzle N in response to the operation of the actuating element.

Further, the wiring board 35 only needs to be disposed in the direction crossing the ink ejection surface 31*a*, and may be disposed to be inclined with respect to the Z direction.

Further, in the above embodiments and modifications, the recording medium M is conveyed by the conveyer 10 including the conveyance belt 103. However, the present invention is not limited thereto. The conveyer 10 may be configured to hold and convey the recording medium M on the outer peripheral surface of a rotating drum, for example.

Further, in the above embodiments and modifications, the inkjet recording device 1 of a single-pass system has been described. However, the present invention may be applied to an inkjet recording device that records an image while scanning a head unit and an inkjet head.

Further, in the above embodiments and modifications, the piezoelectric inkjet recording device 1 using the piezoelectric element 61 has been illustrated. However, the present invention is not limited thereto. For example, the present invention is also applicable to inkjet recording devices of other systems such as a thermal inkjet recording device that ejects ink by creating a bubble through heat application.

Although embodiments of the present invention have been described and illustrated in detail, the disclosed embodiments are made for purposes of illustration and example only and not limitation. The scope of the present invention should be interpreted by terms of the appended claims

INDUSTRIAL APPLICABILITY

The present invention is applicable to an inkjet head and an inkjet recording device.

REFERENCE SIGNS LIST

1 inkjet recording device
10 conveyer
20 head unit
30 inkjet head
31 head chip
31*a* ink ejection surface
32 ink supplier
321 holding substrate
322 ink reservoir
322*a* common ink chamber
33 wiring member
331 driver
34 first connector
35 wiring board
36 exterior member
36*a* projection
361 lower part
362 upper part
37 cover member
37*a* hole
37*b* notch
37*c* movable range restrictor
37*d* through hole
381 second connector
382 aid
39 wiring cable
40 nozzle substrate
50 pressure chamber substrate
51 pressure chamber
60 spacer substrate
61 piezoelectric element
70 wiring forming substrate
M recording medium
N nozzle

The invention claimed is:

1. An inkjet head comprising:

an ink ejector in which an opening of a nozzle that ejects ink is provided in an ink ejection surface, and which includes an actuating element that performs an operation for ejecting ink from the opening of the nozzle;

a wiring board that is provided with a circuit wiring electrically connected to the actuating element, and is disposed in a direction crossing the ink ejection surface on a side opposite to the ink ejection surface of the ink ejector;

an exterior member that covers the ink ejector and the wiring board while exposing the ink ejection surface of the ink ejector and a part of the wiring board;

a wiring cable that is attached to a connection terminal disposed in an area exposed from the exterior member on one surface of the wiring board so as to be electrically connected to the circuit wiring; and a cover member that covers the area of the wiring board exposed from the exterior member and the connection terminal from a side opposite to the ink ejector of the wiring board, wherein the wiring cable passes through a space between an end face of the wiring board on the side opposite to the ink ejector and the cover member, in the cover member, and is led out of the cover member on a surface side opposite to the one surface of the wiring board.

2. The inkjet head according to claim 1, wherein the exterior member and the cover member are configured such that a projection provided on one of the exterior member and the cover member fits into a hole or a recess provided in another of the exterior member and the cover member.

3. The inkjet head according to claim 2, wherein the projection and the hole or the recess are provided in areas of the exterior member and cover member that cover the one surface of the wiring board.

4. The inkjet head according to claim 1, wherein a clearance that circles around the wiring board is provided between the exterior member and the cover member, at a position that is closer to the ink ejection surface than the connector terminal is.

5. The inkjet head according to claim 1, wherein the exterior member and the cover member are disposed such that a clearance between the exterior member and the cover member in a direction parallel to the ink ejection surface in a specific cross-section perpendicular to the ink ejection surface is greater at a predetermined second position than at a predetermined first position, the first position being closer to the ink ejection surface than the connection terminal is, the second position being closer to the ink ejection surface than the connection terminal is, and being farther from the ink ejection surface than the first position is.

6. The inkjet head according to claim 1, wherein a movable range restrictor that restricts a movable range of the wiring cable led out of the cover member is provided on an outer surface of the cover member.

7. The inkjet head according to claim 1, wherein the wiring cable is led out of the cover member through a clearance between the exterior member and the cover member.

8. The inkjet head according to claim 1, wherein a through hole is provided in a surface of the cover member opposite to the one surface of the wiring board; and wherein the wiring cable is led out of the cover member through the through hole.

9. An inkjet recording device comprising:

the inkjet head according to claim 1.

* * * * *